US010357961B2

(12) United States Patent
Zahn

(10) Patent No.: US 10,357,961 B2
(45) Date of Patent: Jul. 23, 2019

(54) STENCILS

(71) Applicant: DTG International GmbH, Zurich (CH)

(72) Inventor: Michael Zahn, Singapore (DE)

(73) Assignee: ASM Assembly Systems Singapore Pte. Ltd., Singapore (SG)

( * ) Notice: Subject to any disclaimer, the term of this patent is extended or adjusted under 35 U.S.C. 154(b) by 133 days.

(21) Appl. No.: 14/368,242

(22) PCT Filed: Dec. 20, 2012

(86) PCT No.: PCT/EP2012/076489
§ 371 (c)(1),
(2) Date: Jun. 23, 2014

(87) PCT Pub. No.: WO2013/092914
PCT Pub. Date: Jun. 27, 2014

(65) Prior Publication Data

US 2015/0165756 A1 Jun. 18, 2015
US 2016/0001545 A9 Jan. 7, 2016

Related U.S. Application Data

(60) Provisional application No. 61/579,766, filed on Dec. 23, 2011.

(51) Int. Cl.
*B41F 15/00* (2006.01)
*B41F 15/34* (2006.01)
(Continued)

(52) U.S. Cl.
CPC ..... *B41F 15/34* (2013.01); *B41M 1/12* (2013.01); *B41N 1/248* (2013.01)

(58) Field of Classification Search
CPC ..... B41F 15/34; B41F 15/36; B41F 15/38; B41F 15/0818; H01L 33/502;
(Continued)

(56) References Cited

U.S. PATENT DOCUMENTS 5,361,695 A * 11/1994 Takagi et al. ..... 101/127
5,888,584 A * 3/1999 Visser-Bartelds et al. ..... 427/58
(Continued)

FOREIGN PATENT DOCUMENTS

GB 2 476 925 A 7/2011

OTHER PUBLICATIONS

International Search Report for corresponding patent application No. PCT/EP2012/076489 dated Feb. 25, 2013.

*Primary Examiner* — Blake A Tankersley
(74) *Attorney, Agent, or Firm* — Renner, Otto, Boisselle & Sklar, LLP

(57) ABSTRACT

A stencil for printing a pattern of deposits on a substrate, wherein the stencil comprises an electroformed metal sheet which has a first layer which includes an apertured region through which a printing medium is applied in a printing operation, and a second layer which overlies a substrate to be printed and includes a plurality of apertures, wherein the apertures of the second layer extend across and beyond the apertured region in the first layer, whereby the second layer includes a plurality of through apertures in registration with the apertured region of the first layer, each having a pattern corresponding to that to be printed on the substrate, and a plurality of blind apertures disposed adjacent and outwardly of the apertured region in the first layer.

24 Claims, 4 Drawing Sheets

(51) Int. Cl.
*B41M 1/12* (2006.01)
*B41N 1/24* (2006.01)

(58) Field of Classification Search
CPC ..... H01L 33/504; H01L 33/50; H01L 2933/0041; H01L 31/02322; F21Y 2101/025; F21V 9/16; F21K 9/56; F21K 9/135
USPC ..... 427/143
See application file for complete search history.

(56) References Cited

U.S. PATENT DOCUMENTS

| | | | | |
|---|---|---|---|---|
| 2003/0061948 | A1 | 4/2003 | Coleman | |
| 2008/0074032 | A1* | 3/2008 | Yano | F21S 6/003 313/503 |
| 2008/0093614 | A1* | 4/2008 | Nagai | 257/98 |
| 2013/0299773 | A1* | 11/2013 | Kim | H01L 29/7613 257/10 |

* cited by examiner

STENCILS

This application is a national phase of International Application No. PCT/EP2012/076489 filed Dec. 20, 2012 and published in the English language, which claims priority to U.S. Provisional Application No. 61/579,766 filed Dec. 23, 2011.

The present invention relates to a stencil, often referred to as a printing screen or foil, for printing patterns of a printing medium onto substrates, in particular wafers or transfer carriers.

The present invention has particular application in the printing of conversion phosphors onto wafer dies, such as in depositing yellow down-conversion phosphors, for example, YAG-Ce, for the down conversion of UV and/or blue light from light-emitting devices, such as LEDs or lasers, to provide white light.

In printing such phosphors, it is important that the material be deposited with a high degree of uniformity, in order to achieve uniform luminescence and thus color temperature.

Conventionally, down-conversion phosphors are dispensed using dispensing devices, and attempts to print phosphors using stencils have suffered from the problem of exhibiting low wafer yields, typically around 50%, in that the prints on a significant number of prints do not have the required uniformity, resulting in significant wastage from each printed wafer.

It is an aim of the present invention to provide an improved stencil for printing patterns of printing medium onto substrates, in particular wafers or transfer carriers, and especially in the printing of down-conversion phosphors onto wafers, such as sapphire or silicon wafers, in the fabrication of light-emitting devices for emitting white light.

In one aspect the present invention provides a stencil for printing a pattern of deposits on a substrate, wherein the stencil comprises an electroformed metal sheet which has a first layer which includes an apertured region through which a printing medium is applied in a printing operation, and a second layer which overlies a substrate to be printed and includes a plurality of apertures, wherein the apertures in the second layer extend across and beyond the apertured region in the first layer, whereby the second layer includes a plurality of through apertures in registration with the apertured region of the first layer, each having a pattern corresponding to that to be printed on the substrate, and a plurality of blind apertures disposed adjacent and outwardly of the apertured region in the first layer.

In one embodiment the metal sheet is formed of nickel or a nickel alloy.

In one embodiment the layers of the stencil are integrally formed.

In one embodiment the layers are formed of the same material.

In another embodiment the layers are formed of different materials.

In one embodiment the apertured region corresponds in shape and size to the substrate to be printed.

In one embodiment the apertured region is circular in shape.

In one embodiment the apertured region has the form of a grid which comprises orthogonally-arranged web elements, which together define apertures therebetween.

In one embodiment the apertures of the first layer are rectangular.

In one embodiment the web elements of the first layer have a width of from about 10 μm to about 120 μm, preferably from about 20 μm to about 110 μm, more preferably from about 30 μm to about 100 μm, and more preferably about 30 μm or about 100 μm.

In one embodiment the web elements of the first layer have a width of from about 10 μm to about 40 μm, preferably from about 20 μm to about 40 μm, and more preferably about 30 μm.

In one embodiment the web elements of the first layer have a width of from about 80 μm to about 120 μm, preferably from about 90 μm to about 110 μm, and more preferably about 100 μm.

In one embodiment the apertures of the first layer have an area of at least about 0.001 $mm^2$, preferably from about 0.001 $mm^2$ to about 1 $mm^2$, more preferably at least about 0.0015 $mm^2$, still more preferably from about 0.0015 $mm^2$ to about 1 $mm^2$, yet more preferably at least about 0.0025 $mm^2$, yet still more preferably from about 0.0025 $mm^2$ to about 1 $mm^2$, and still yet more preferably not more than about 0.25 $mm^2$.

In one embodiment the apertures of the first layer have side lengths of at least about 50 μm, preferably at least about 100 μm, more preferably at least about 250 μm, and still more preferably not more than about 1 mm.

In one embodiment the first layer has a thickness of from about 10 μm to about 120 μm, preferably from about 20 μm to about 110 μm, more preferably from about 30 μm to about 100 μm, and still more preferably about 30 μm or about 100 μm.

In one embodiment the first layer has a thickness of from about 20 μm to about 60 μm, preferably from about 20 μm to about 50 μm, more preferably from about 25 μm to about 35 μm, and still more preferably about 30 μm.

In one embodiment the first layer has a thickness of from about 80 μm to about 120 μm, preferably from about 90 μm to about 110 μm, and preferably about 100 μm.

In one embodiment the apertures in the second layer have a substantially square form, separated by orthogonally-arranged web elements.

In one embodiment the web elements of the second layer have a width of from about 100 μm to about 200 μm, preferably from about 100 μm to about 150 μm.

In one embodiment the apertures in the second layer are arranged in the form of a regular array.

In one embodiment the apertures in the second layer repeat laterally outwardly beyond the apertured region of the first layer.

In one embodiment the apertures of the second layer extend laterally beyond the apertured region of the first layer by a distance of at least about 2 mm, preferably from about 2 mm to about 30 mm, more preferably from about 2 mm to about 20 mm, still more preferably at least about 5 mm, yet more preferably from about 5 mm to about 20 mm, and still more preferably from about 5 mm to about 10 mm.

In one embodiment the substrate is a wafer, preferably a silicon or sapphire wafer.

In another embodiment the substrate is a transfer carrier for transferring the prints to a wafer, preferably a silicon or sapphire wafer.

In another aspect the present invention provides a method of printing substrates with a pattern of deposits using the above-described stencil.

In one embodiment the method is for printing deposits of a down-conversion phosphor on a substrate, preferably a yellow down-conversion phosphor.

In one embodiment the method comprises the steps of: providing a substrate; providing the above-described stencil over the substrate; applying print medium over the stencil, such that the print medium is forced through the apertures in the second layer and a pattern of deposits is printed on the substrate corresponding to the pattern of through apertures in the second layer of the stencil.

In one embodiment the substrate is a wafer, preferably a silicon or sapphire wafer, and the deposits are printed directly onto dies formed in the wafer without any intermediate transfer steps.

In a further aspect the present invention provides a method of fabricating a light-emitting device, comprising the steps of: performing the above-described printing step; and separating the printed dies of the wafer.

In one embodiment at least 90% of the printed dies of the wafer are selected, and further comprising the step of: providing each of the selected dies in device packaging to provide light-emitting devices.

In one embodiment the deposits on the selected dies of the wafer are not subjected to any surface thickness processing.

A preferred embodiment of the present invention will now be described hereinbelow by way of example only with reference to the accompanying drawings, in which:

FIGS. 1 to 4 illustrate a stencil 3 in accordance with a preferred embodiment of the present invention, mounted in a supporting frame 4, in this embodiment a VectorGuard® frame (as supplied by DEK).

The stencil 3 comprises an electroformed metal sheet, in this embodiment of solid metal, here of nickel or a nickel alloy. In alternative embodiments the stencil 3 could be formed of other electroformable metals or alloys or combinations thereof.

Figure 1:
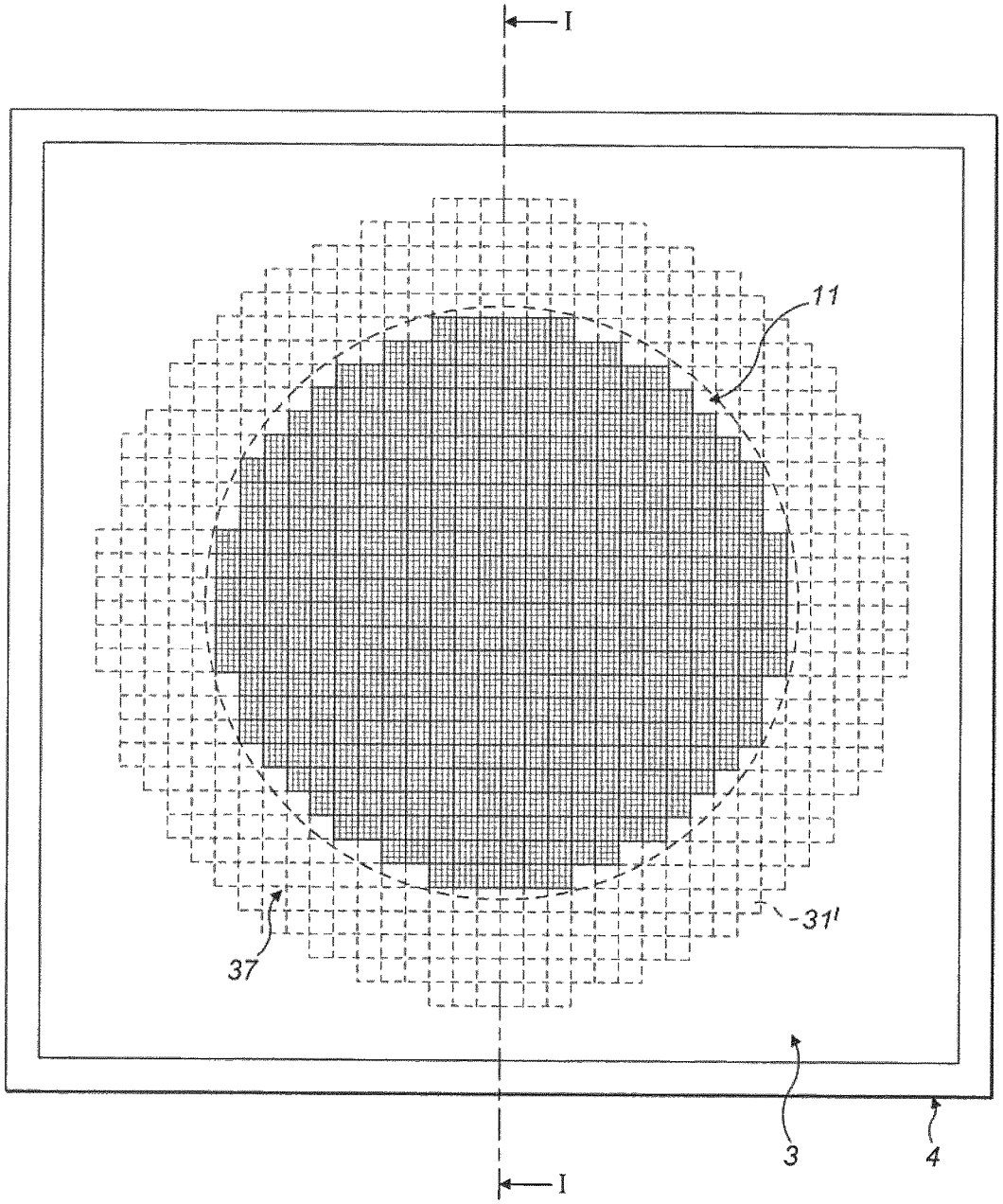
FIG. 1 illustrates a plan view of a stencil in accordance with a preferred embodiment of the present invention, mounted in a supporting frame.
Figure 2:
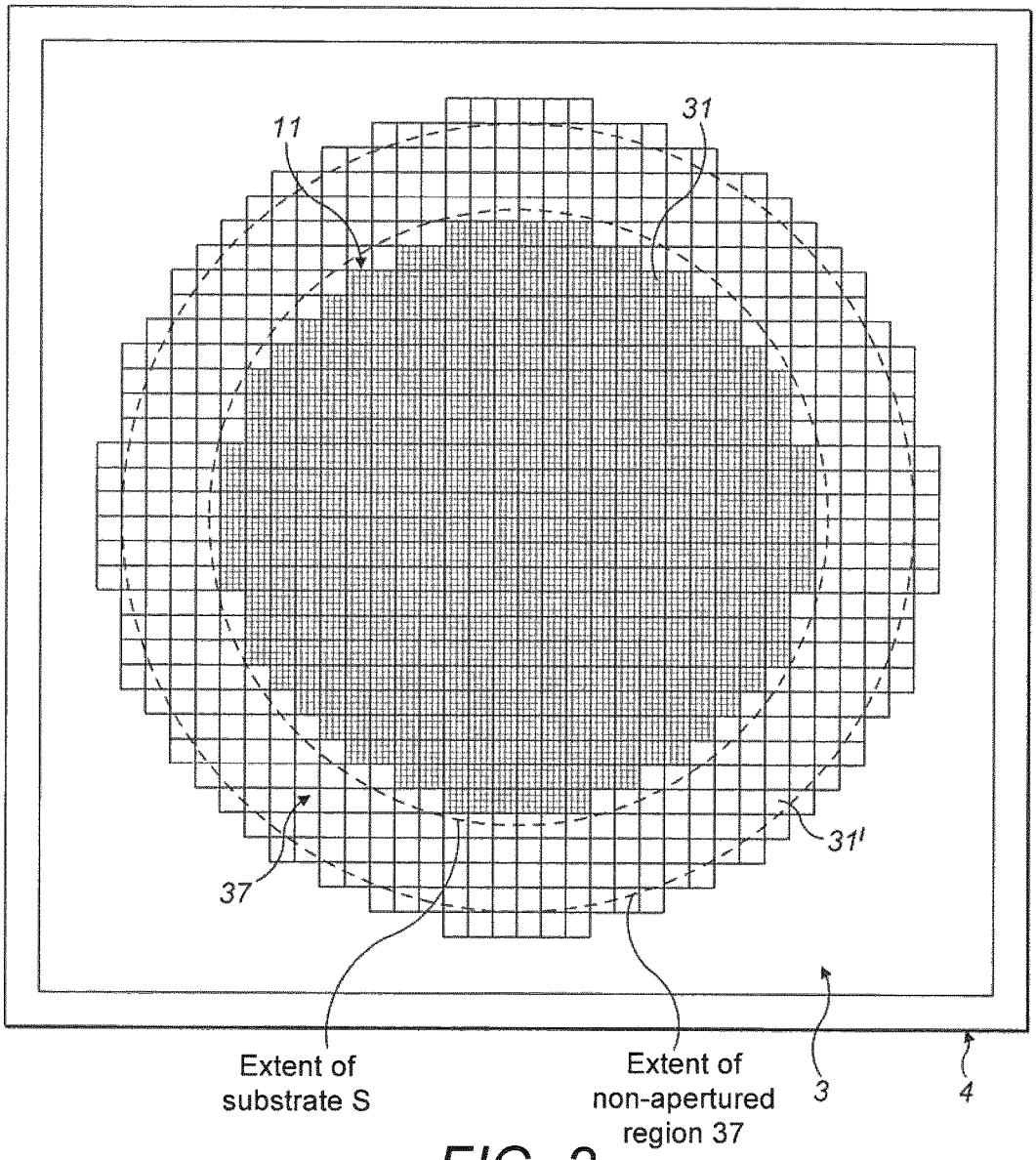
FIG. 2 illustrates an underneath view of the stencil of FIG. 1.
Figure 3:
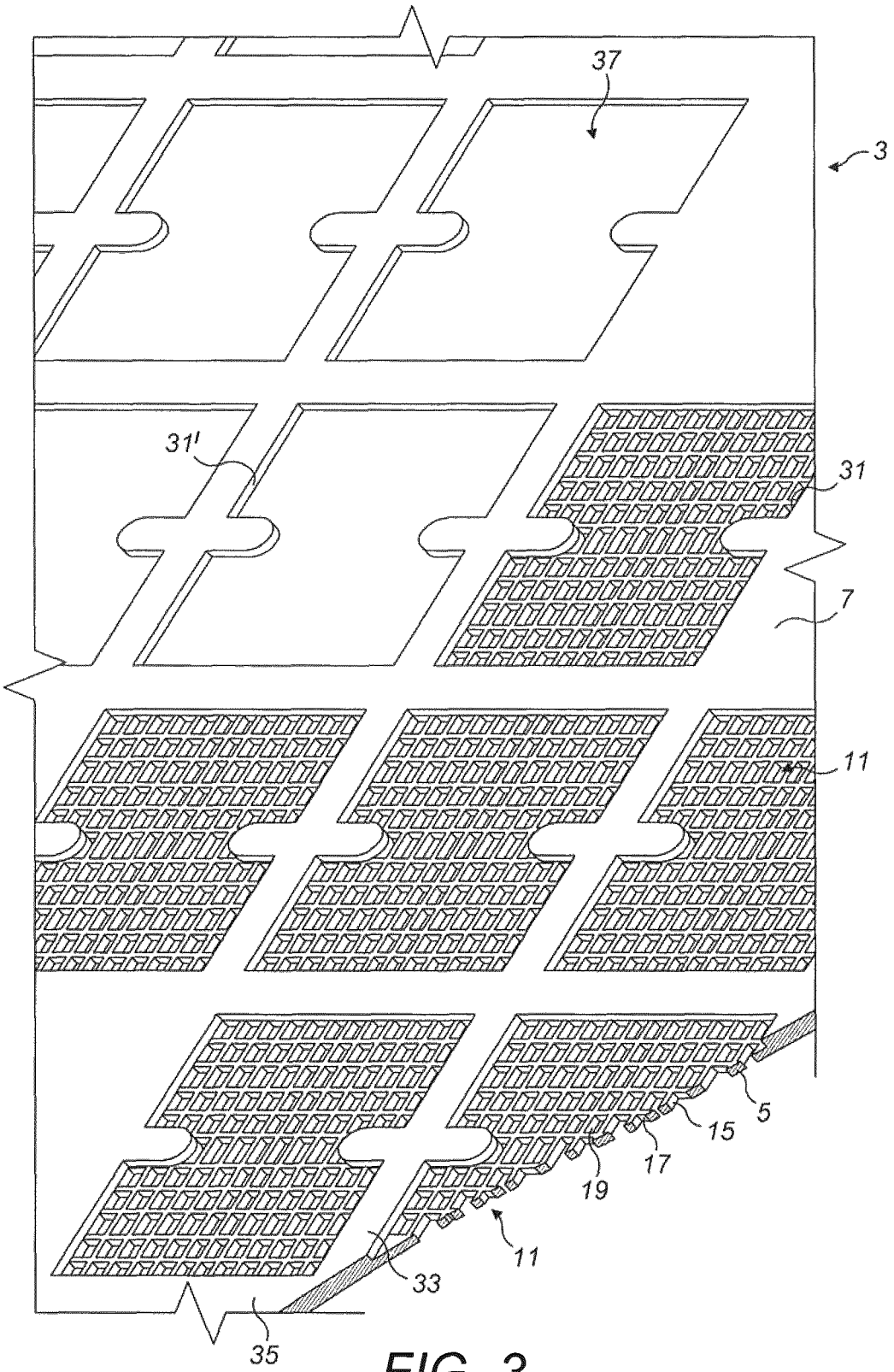
FIG. 3 illustrates a fragmentary, sectional perspective view of the stencil of FIG. 1 (illustrated in an inverted orient from the operative orient)
Figure 4:
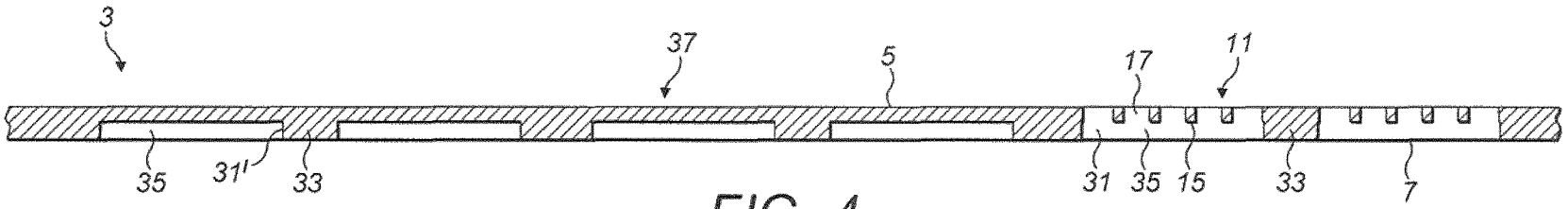
FIG. 4 illustrates a vertical sectional view (along section I-I in FIG. 1) of the stencil of FIG. 1.

As illustrated in FIGS. 3 and 4, the stencil 3 comprises a first, upper layer 5 over which a printing medium is applied in a printing operation, typically using a squeegee or an enclosed print head, and a second, lower layer 7, which overlies a substrate which is to be printed.

In this embodiment the layers 5, 7 of the stencil 3 are integrally formed. In one embodiment the layers 5, 7 are formed of the same material. In another embodiment the layers 5, 7 are formed of different materials.

The upper layer 5 includes an apertured region 11, in this embodiment of circular shape, which corresponds in shape and size to the substrate to be printed, and through which printing medium is delivered in a printing operation. It will be understood that the apertured region 11 could have any shape, for example, rectangular.

In this embodiment the apertured region 11 has the form of a grid, which comprises orthogonally-arranged web elements 15, 17, which together define apertures 19 therebetween, through which printing medium can be delivered. In this embodiment the apertures 19 are rectangular, typically square or oblong, but in other embodiments could have different shape, such as circular.

In this embodiment the web elements 15, 17 have a width of from about 10 μm to about 120 μm, preferably from about 20 μm to about 110 μm, more preferably from about 30 μm to about 100 μm, and more preferably about 30 μm or about 100 μm.

In one embodiment the web elements 15, 17 have a width of from about 10 μm to about 40 μm, preferably from about 20 μm to about 40 μm, and more preferably about 30 μm.

In another embodiment the web elements 15, 17 could have a width of from about 80 μm to about 120 μm, preferably from about 90 μm to about 110 μm, and more preferably about 100 μm.

In this embodiment the apertures 19 have an area of at least about 0.001 $mm^2$, preferably from about 0.001 $mm^2$ to about 1 $mm^2$, more preferably at least about 0.0015 $mm^2$, still more preferably from about 0.0015 $mm^2$ to about 1 $mm^2$, yet more preferably at least about 0.0025 $mm^2$, yet still more preferably from about 0.0025 $mm^2$ to about 1 $mm^2$, and still yet more preferably not more than about 0.25 $mm^2$.

In one embodiment the apertures 19 have side lengths of at least about 50 μm, preferably at least about 100 μm, more preferably at least about 250 μm, and still more preferably not more than about 1 mm.

In this embodiment the upper layer 5 has a thickness of from about 10 μm to about 120 μm, preferably from about 20 μm to about 110 μm, more preferably from about 30 μm to about 100 μm, and still more preferably about 30 μm or about 100 μm.

In one embodiment the upper layer 5 has a thickness of from about 20 μm to about 60 μm, preferably from about 20 μm to about 50 μm, more preferably from about 25 μm to about 35 μm, and still more preferably about 30 μm.

In another embodiment the upper layer 5 has a thickness of from about 80 μm to about 120 μm, preferably from about 90 μm to about 110 μm, and preferably about 100 μm.

The lower layer 7 includes a plurality of apertures 31, which each have a pattern corresponding to that to be printed on the substrate.

In this embodiment the apertures 31 each have a substantially square form, separated by orthogonally-arranged web elements 33, 35, but it should be understood that the apertures 31 could have any desired form.

In this embodiment the web elements 33, 35 have a width of from about 100 μm to about 200 μm, preferably from about 100 μm to about 150 μm.

In this embodiment the apertures 31 are arranged in the form of a regular array, with the apertures 31 being registered to dies on a substrate, in this embodiment a wafer.

The apertures 31 repeat laterally beyond the apertured region 11 of the upper layer 5 in a non-apertured region 37.

In this embodiment the apertures 31 extend laterally beyond the apertured region 11 by a distance of at least about 2 mm, preferably from about 2 mm to about 30 mm, more preferably from about 2 mm to about 20 mm, still more preferably at least about 5 mm, yet more preferably from about 5 mm to about 20 mm, and still more preferably from about 5 mm to about 10 mm.

With this arrangement the apertures 31 in the non-apertured region 37 define blind apertures or recesses 31' in the lower surface of the stencil 3.

The present inventors have identified that, by extending the apertures 31 in the lower layer 7 beyond the apertured region 11 in the upper layer 5 to provide the blind apertures or recesses 31', the stencil 3 provides for significantly improved performance in printing across the entire substrate, and thus significantly-improved yield.

It has been found that, with this configuration, and in one example in the printing of a yellow down-conversion phosphor, the yield is remarkably increased to at least 90%, as compared to yields of about 70% for a stencil of the same design but having no blind apertures recesses 31', and, for some wafers, yields of 99% have been achieved.

Such is the improvement that it is not necessary to finish the surface of the prints, such as by lapping, to achieve a required thickness and thickness uniformity, or to check the thickness, where printed onto a transfer carrier, prior to transfer onto the dies of a wafer, as are done currently.

Finally, it will be understood that the present invention has been described in its preferred embodiment and can be modified in many different ways without departing from the scope of the invention as defined by the appended claims.

The invention claimed is:

1. A stencil for printing a pattern of deposits on a substrate, wherein the stencil comprises an electroformed metal sheet which has a first layer which includes an apertured region through which a printing medium is applied in a printing operation, wherein the apertured region has the form of a grid which comprises orthogonally-arranged web elements, which together define apertures therebetween, and a second layer which overlies a substrate to be printed and includes a plurality of separated apertures, wherein the apertures of the second layer extend across and beyond the apertured region in the first layer, with the apertures in the second layer being arranged in the form of a regular array which repeats laterally across and outwardly beyond the apertured region of the first layer, and wherein the apertures of the second layer disposed adjacent and outwardly of the apertured region in the first layer are blind apertures and the apertures of the second layer disposed inwardly of and enclosed by the blind apertures are through apertures, each having a pattern corresponding to that to be printed on the substrate.

2. The stencil of claim 1, wherein the metal sheet is formed of nickel or a nickel alloy.

3. The stencil of claim 1, wherein the layers of the stencil are integrally formed.

4. The stencil of claim 1, wherein the apertured region corresponds in shape and size to the substrate to be printed.

5. The stencil of claim 4, wherein the apertured region is circular in shape.

6. The stencil of claim 1, wherein the apertures of the first layer are rectangular.

7. The stencil of claim 6, wherein the web elements of the first layer have a width of from about 10 μm to about 120 μm, from about 20 μm to about 110 μm, from about 30 μm to about 100 μm, about 30 μm or about 100 μm.

8. The stencil of claim 7, wherein the web elements of the first layer have a width of from about 10 μm to about 40 μm, from about 20 μm to about 40 μm or about 30 μm.

9. The stencil of claim 7, wherein the web elements of the first layer have a width of from about 80 μm to about 120 μm, from about 90 μm to about 110 μm or about 100 μm.

10. The stencil of claim 1, wherein the apertures of the first layer have an area of at least about 0.001 $mm^2$, from about 0.001 $mm^2$ to about 1 $mm^2$, at least about 0.0015 $mm^2$, from about 0.0015 $mm^2$ to about 1 $mm^2$, at least about 0.0025 $mm^2$, from about 0.0025 $mm^2$ to about 1 $mm^2$ or not more than about 0.25 $mm^2$.

11. The stencil of claim 1, wherein the apertures of the first layer have side lengths of at least about 50 μm, at least about 100 μm, at least about 250 μm or not more than about 1 mm.

12. The stencil of claim 1, wherein the first layer has a thickness of from about 10 μm to about 120 μm, from about 20 μm to about 110 μm, from about 30 μm to about 100 μm, about 30 μm or about 100 μm.

13. The stencil of claim 12, wherein the first layer has a thickness of from about 20 μm to about 60 μm, from about 20 μm to about 50 μm, from about 25 μm to about 35 μm or about 30 μm.

14. The stencil of claim 12, wherein the first layer has a thickness of from about 80 μm to about 120 μm, from about 90 μm to about 110 μm or about 100 μm.

15. The stencil of claim 1, wherein the apertures in the second layer each have a substantially square form, separated by orthogonally-arranged web elements.

16. The stencil of claim 15, wherein the web elements of the second layer have a width of from about 100 μm to about 200 μm or from about 100 μm to about 150 μm.

17. The stencil of claim 1, wherein the apertures of the second layer extend laterally beyond the apertured region of the first layer by a distance of at least about 2 mm, from about 2 mm to about 30 mm, from about 2 mm to about 20 mm, at least about 5 mm, from about 5 mm to about 20 mm or from about 5 mm to about 10 mm.

18. The stencil of claim 1, wherein the layers are formed of the same material or different materials.

19. The stencil of claim 1, wherein the substrate is (a) a wafer, a silicon wafer or a sapphire wafer, or (b) a transfer carrier for transferring the prints to a wafer, a silicon wafer or a sapphire wafer.

20. A method of printing substrates with a pattern of deposits, comprising:

providing a substrate;

providing a stencil for printing a pattern of deposits on a substrate, wherein the stencil comprises an electroformed metal sheet which has a first layer which includes an apertured region through which a printing medium is applied in a printing operation, wherein the apertured region has the form of a grid which comprises orthogonally-arranged web elements, which together define apertures therebetween, and a second layer which overlies a substrate to be printed and includes a plurality of separated apertures, wherein the apertures of the second layer extend across and beyond the apertured region in the first layer, with the apertures in the second layer being arranged in the form of a regular array which repeats laterally across and outwardly beyond the apertured region of the first layer, and wherein the apertures of the second layer disposed adjacent and outwardly of the apertured region in the first layer are blind apertures and the apertures of the second layer disposed inwardly of and enclosed by the blind apertures are through apertures, each having a pattern corresponding to that to be printed on the substrate; and applying print medium over the stencil, such that the print medium is forced through the apertures in the second layer and a pattern of deposits is printed on the substrate corresponding to the pattern of through apertures in the second layer of the stencil.

21. The method of claim 20, wherein the substrate is a wafer, and the deposits are printed directly onto dies formed in the wafer without any intermediate transfer steps.

22. A method of fabricating light-emitting devices, comprising:

providing a substrate, wherein the substrate is a wafer having dies formed therein;

providing a stencil for printing a pattern of deposits on the substrate, wherein the stencil comprises an electroformed metal sheet which has a first layer which includes an apertured region through which a printing medium is applied in a printing operation, and a second layer which overlies a substrate to be printed and includes a plurality of separated apertures, wherein the apertures of the second layer extend across and beyond the apertured region in the first layer, with the apertures in the second layer being arranged in the form of a regular array which repeats laterally across and outwardly beyond the apertured region of the first layer, and wherein the apertures of the second layer include a plurality of through apertures in registration with the apertured region of the first layer, each having a pattern corresponding to that to be printed on the substrate, and a plurality of blind apertures disposed adjacent and outwardly of the apertured region in the first layer;

applying print medium over the stencil, such that the print medium is forced through the apertures in the second layer and a pattern of deposits is printed on the substrate to provide printed dies corresponding to the pattern of through apertures in the second layer of the stencil;

separating the printed dies of the wafer;

selecting a plurality of the separated printed dies; and providing the selected printed dies in device packaging to provide light-emitting devices.

23. The method of claim 22, wherein at least 90% of the separated printed dies are selected in the separating step.

24. The method of claim 23, wherein the deposits on the selected printed dies are not subjected to any surface thickness processing.

* * * * *